United States Patent [19]

Gardetto

[11] Patent Number: 4,961,694

[45] Date of Patent: Oct. 9, 1990

[54] LEVER ARM PUMP

[76] Inventor: William W. Gardetto, 1721 Louella Ct., Hurst, Tex. 76054

[21] Appl. No.: 342,043

[22] Filed: Apr. 24, 1989

[51] Int. Cl.[5] ..... F04B 19/02

[52] U.S. Cl. ..... 417/464; 417/307; 92/119

[58] Field of Search ..... 417/305, 307, 464, 469, 417/571; 92/118, 119

[56] References Cited

U.S. PATENT DOCUMENTS 2,282,652 5/1942 Henning ..... 92/118
3,399,786 9/1968 Honeycutt ..... 92/119
3,699,851 10/1972 Kennedy .

*Primary Examiner*—Leonard E. Smith
*Assistant Examiner*—Robert N. Blackmon
*Attorney, Agent, or Firm*—Wheeler Law Firm

[57] ABSTRACT

A pump is described including an elongated cylindrical reservoir, a valve casing, at which the pump is pivotally fixed in space, and a pump chamber which are in a linear arrangement. A piston within the pump chamber is connected to a link, the end of which is pivotally fixed in space. A handle atop the reservoir is used to pump fluid from the reservoir to an attached device to be operated. Bores and check valves within the valve casing regulate the flow of fluid through the pump. A release mechanism which allows fluid to flow from the attached device to be operated back into the reservoir is activated by rotating the handle.

4 Claims, 3 Drawing Sheets

(MAXIMUM INTAKE POSITION)

(MAXIMUM PUMP POSITION)

LEVER ARM PUMP

BACKGROUND OF THE INVENTION

Many hand pumps are known for both continually pumping fluid and for pumping fluid for building up hydraulic pressure to achieve a desired result. None, however, are known to the inventor which are hand activated having the fluid reservoir, piston, pump chamber and necessary valves contained in the handle itself, wherein the piston is actuated by means of a link arm the end of which is fixed in space and which allows both the pumping and hydraulic pressure release functions to be performed with a single hand leaving the other hand and both feet free for additional operations.

SUMMARY OF THE INVENTION

The present invention provides a hand pump for pumping fluid to an operating device either to produce a continual flow or to build up hydraulic pressure within the operating device. In the present invention an elongated cylindrical power fluid reservoir is sealed at its top by a handle assembly and at its bottom by a valve casing. The valve casing also seals the top of a cylindrical pump housing within which is located a piston which slides within and seals the pump housing such that a pump chamber is formed between the valve casing and the piston. A piston rod which is connected to the piston and extends out of the bottom of the pump housing is pivotally connected to a link arm. The pump is pivotally fixed in space at the valve casing and the link arm such that a back and forth lateral movement of the handle causes the piston to slide within the pump housing so as to alternately increase and decrease the size of the pump chamber thereby drawing fluid from the reservoir to the pump chamber and then pumping the fluid to the operating device with the flow of fluid being controlled by a number of check valves within the valve casing. A mechanism for releasing hydraulic pressure built up in the operating device is activated by turning the handle assembly.

By having pump housing, valve casing, reservoir and handle in a linear configuration to form a lever arm the present invention is self-contained, compact and easily operated due to the leverage afforded by the configuration. Use of a link arm to provide a durable and reliable means to actuate the piston of such a pump is unique to the present invention. Additionally, by having the release mechanism operated by the same handle which is used to pump, the present invention frees the operator's other hand and both feet for other operations.

The configuration of the link gives very high mechanical advantage and easy operation, and at the same time serves as a stop to limit movement to the appropriate degree for the attached piston, preventing accidental damage. These and other benefits of the present invention will be disclosed to one skilled in the art from the following description.

DESCRIPTION OF PREFERRED EMBODIMENT

Figure 1:
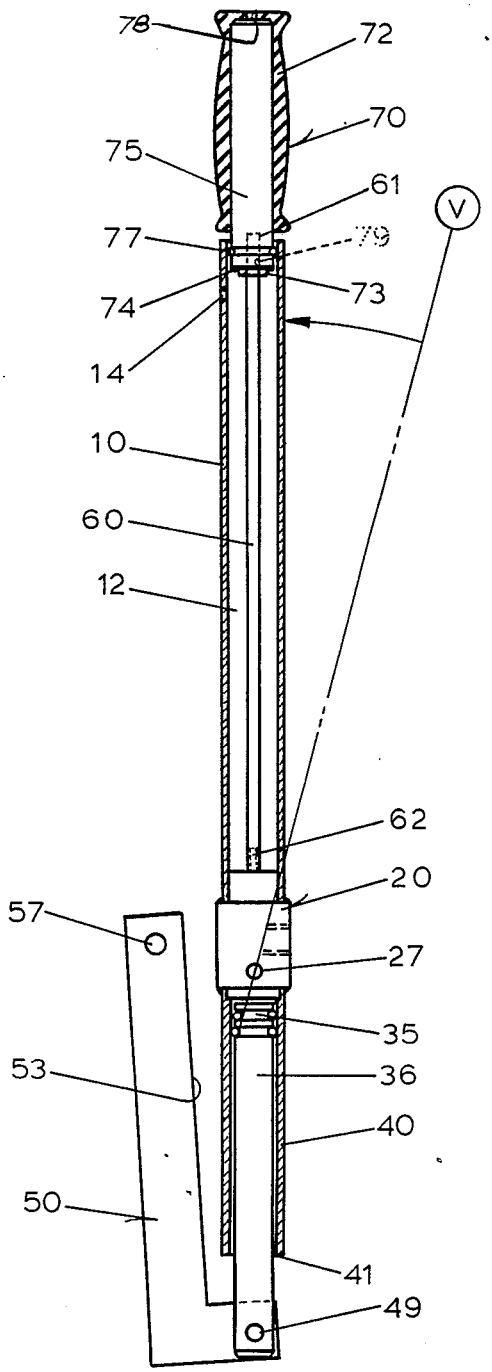
FIG. 1 is a side view of the invention with the handle assembly, reservoir and pump housing in cross section.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

An elongated cylindrical housing 10 defines a fluid reservoir 12 which is sealed at the top by a handle assembly 70 and at its bottom by a valve casing 20. A release rod 60 runs from the handle assembly 70 to the top 21 of the valve casing 20. The bottom end of the valve casing 20 seals a cylindrical pump housing 40 in which a cylindrical power piston 35 is received in a slideable sealing engagement. O-rings 37 provide the necessary seal. The piston rod 36 extends beyond the bottom 41 of the pump housing 40, where it is pivotally connected to L-shaped link arm 50 at hole 49. For increased simplicity, economy and durability in the preferred embodiment the piston rod 36 and the piston 35 are one part with the piston rod 36 having a slightly smaller diameter than the piston 35.

The pump is fixed in space in a manner which allows pivoting at hole 57 of the link arm 50 and horizontal bore 27 in the valve casing 20 so that the inside edge 53 of the link arm 50 is parallel to the pump housing 40. When the inside edge 53 of the link arm 50 is parallel to the pump housing 40 the mechanism is in what will hereinafter be referred to as the "rest position". In the rest position a pump chamber 30 is formed between the piston 35 and the bottom 22 of the valve casing 20.

Figure 4:
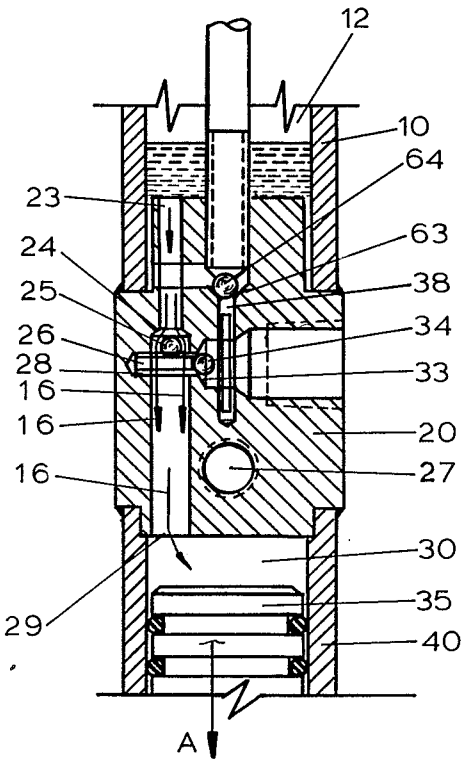
FIG. 4 is a cross section of the valve casing of the present invention during intake stroke.

By pushing the handle assembly 70 in the direction away from the link arm 50 an operator performs what will hereinafter be referred to as the "intake stroke". Referring now to FIG. 4, which illustrates the interior of the valve casing during the intake stroke, the piston 35 moves downward as indicated by arrow A thereby increasing the size of the pump chamber 30. This draws fluid through port 29, which causes the inlet valve ball 25 to be pulled away from the inlet valve seat 24 allowing fluid to travel from the reservoir 12 through inlet bore 23 and ultimately to the pump chamber 30. The path of the flowing fluid is represented by arrows 16. A vent hole 14 near the top of the reservoir 12 prevents the creation of a vacuum within the reservoir 12 during the intake stroke. Vent 14 may also serve as an intake port if it is desired to use the device of this invention for pumping in one direction in an amount greater than the capacity of the reservoir. Pin 26 sits in horizontal pin bore 28 and limits the distance valve ball 25 can move from valve seat 24. The fluid being drawn toward the expanding pump chamber 30 keeps the outlet valve ball 34 against outlet valve seat 33. As will be seen later, any pressure built up in an attached device to be operated will also keep ball 34 against seat 33 during the intake stroke.

Figure 3:
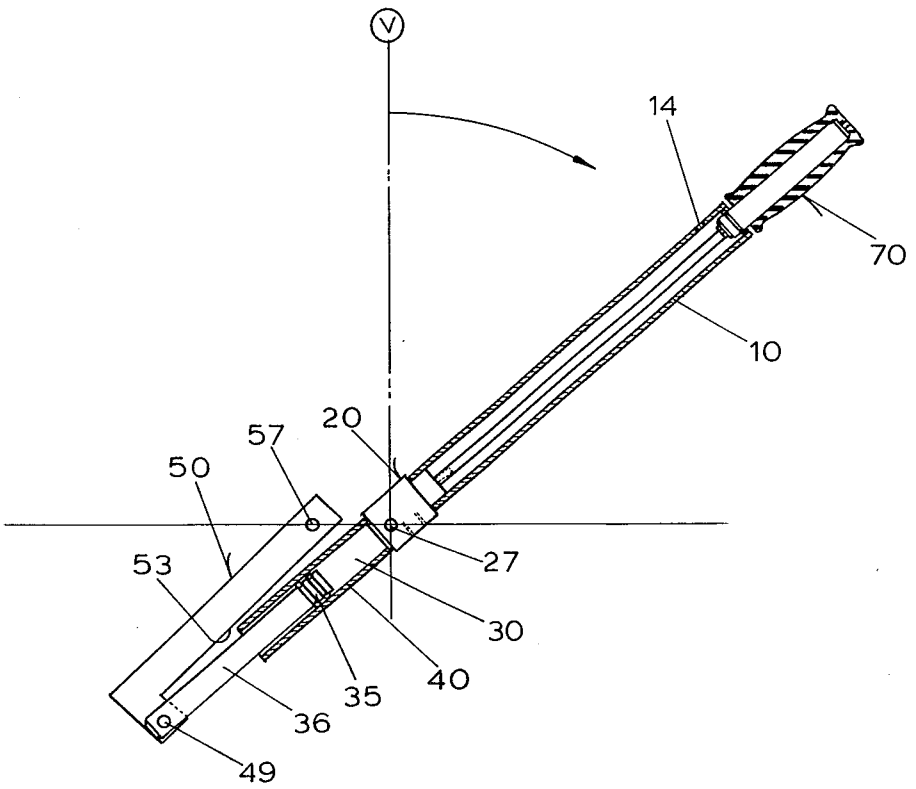
FIG. 3 is a side view of the invention in the maximum intake position with the handle assembly, reservoir and pump housing in cross section.
Figure 2:
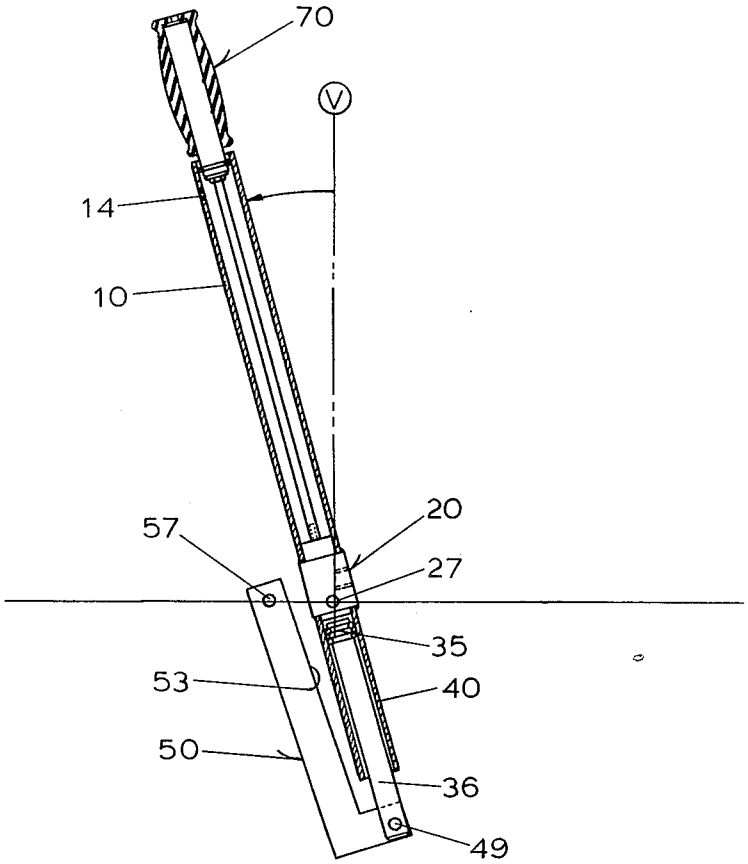
FIG. 2 is a side view of the invention in the maximum pump position with the handle assembly, reservoir and pump housing in cross section.

The length of the intake stroke is physically limited by the configuration of the link arm 50 and the pump housing 40. FIG. 3 illustrates the maximum intake position which is reached when the pump housing 40 comes into contact with the inside 53 of the link arm. It is not, however, necessary for the maximum intake position to be achieved in order for the pump to operate.

Figure 5:
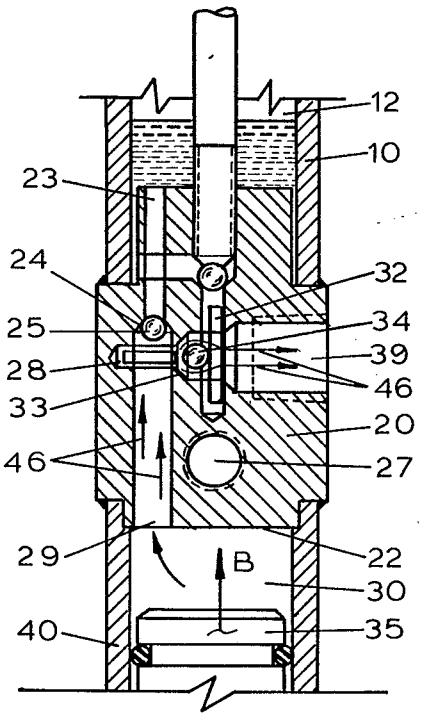
FIG. 5 is a cross section of the valve casing of the present invention during a pump stroke.

By pulling the handle assembly 70 back towards and beyond the rest position, the operator performs what we will hereinafter be referred to as the "pump stroke". FIG. 5, which illustrates the interior of the valve casing during the pump stroke, shows the piston 35 moving towards the bottom 22 of the valve casing 20 as indicated by arrow B decreasing the size of the pump chamber 30. This causes fluid to flow through port 29, causing ball 25 to be forced against the valve seat 24 thereby effectively sealing off and preventing the flow of fluid back into the reservoir 12. The flow of fluid during the pump stroke is indicated by arrows 46. Simultaneously, the flow of fluid forces ball 34 away from valve seat 33 allowing fluid to flow out of port 39 and into an attached device to be operated. Pin 32 sits in vertical pin bore 38 and limits the distance valve ball 34 can move away from valve seat 33. The piston 35 contacting the bottom 22 of the valve casing 20 physically constrains the length of the pump stroke.

The next intake stroke is begun by moving the handle assembly 70 back towards the rest position. By repeating the intake and pump strokes, fluid is drawn from the reservoir 12 to the pump chamber 30 and pumped into an attached device to be operated increasing the hydraulic pressure in the attached device thereby achieving the desired result.

The handle assembly 70 consists of a grip 72 and a plug 75. The grip 72 is made of hard plastic or rubber and shaped to be securely and comfortably grasped by the operator during operation. A hole 78 in the grip 72 facilitates the insertion of the plug 75 therein. The plug 75 fits tightly within the grip 72 to help ensure that the grip 72 will not come off during operation.

The plug 75 seals the reservoir 12. An O-ring 77 provides the necessary seal, and enough frictional drag to prevent any undesired, inadvertent turning of the handle assembly 70. The bottom 74 of the plug 75 has a threaded vertical bore 79 into which the threaded top end 61 of the release rod 60 is screwed. Nut 73 locks the threaded top end 61 of the release rod 60 into bore 79 and prevents the plug 75 from rotating relative to the release rod 60 when the handle assembly 70 is turned. Thus, the plug 75 and release rod 60 rotate together when the handle assembly 70 is turned.

Figure 6:
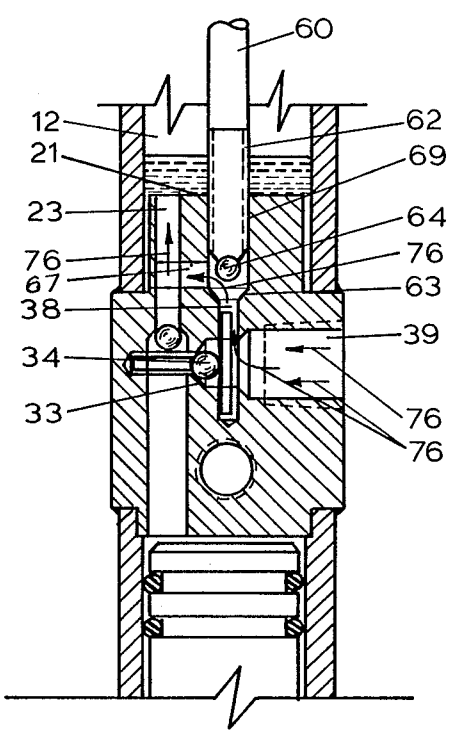
FIG. 6 is a cross section of the valve casing of the present invention when the release rod is in the release position.

The threaded bottom end 62 of the release rod 60 is screwed into a threaded vertical bore 69 in the top 21 of the valve casing 20. FIGS. 4 and 5 show the release rod 60 in what will hereinafter be referred to as the "closed position". When in the closed position, the release rod 60 maintains the release valve ball 64 against the release valve seat 63. This seals the top of vertical pin bore 38. By turning the hand assembly 70 this operator slightly unscrewed the bottom end 62 of the release rod 60. When slightly unscrewed the release rod 60 is in what will hereinafter be referred to as the "release position". FIG. 6 illustrates the interior of the valve casing 20 when the release rod 60 is in the release position. Any hydraulic pressure in an attached device to be operated which was built up by pumping will force release valve ball 64 away from release valve seat 63 while maintaining ball 34 against the valve seat 33. This will cause fluid to flow back into the valve casing 20 through port 39 and follow a path indicated by arrows 76. The fluid will flow through vertical pin bore 38 to horizontal bore 67 and from there through inlet bore 23 and back into the reservoir 12.

What is claimed is:

1. A hand pump for pumping fluid to an operating device, comprising:

a unitary pump handle extending in a generally vertical direction; a cylindrical reservoir forming an upper section of said handle and having an inlet near the top thereof; a cylindrical pump housing forming a lower portion of said handle; a plug which is inserted into and seals one end of said reservoir, said plug having a handle attached thereto, a valve casing having one end inserted into and sealing said reservoir and the other end inserted into and sealing said pump housing to connect said reservoir and said pump housing in a linear series to form said handle;

a piston in said pump housing; pivot means supporting said handle at said valve casing for movement about a generally horizontal axis;

a pump chamber formed between said piston and said valve casing; a link arm; means pivotally securing a point on said link arm on an axis close to said handle which is fixed respecting said generally horizontal axis;

a piston rod having one end attached to said piston and the other end pivotally connected to said link arm at a location vertically spaced from the means pivotally supporting a point on said link arm such that lateral movement of said handle causes said piston to slide within said pump housing and change the size of said pump chamber;

one way flow regulating means in said valve casing which allows fluid to flow only from said reservoir into said pump chamber when said piston slides in a direction to enlarge said pump chamber, and allows said fluid to flow only from said pump chamber to an operating device when said piston slides in a direction to decrease the size of said pump chamber; and a single release means to open said flow regulating means to two way flow.

2. The pump of claim 1 wherein said flow regulating means comprises:

a first vertical bore which extends through said valve casing and connects said reservoir to said pump chamber; a first check valve located in said first vertical bore which allows the unidirectional flow of fluid through said first vertical bore from said reservoir to said pump chamber; a first horizontal bore in said valve casing which intersects said first vertical bore between said first check valve and said pump chamber; an outlet port having means for connecting an operating device thereto located where said first horizontal bore passes out of said valve casing; a second check valve located in said first horizontal bore which allows the unidirectional flow of fluid through said first horizontal bore from said pump chamber to an operating device connected to said outlet port.

3. The pump of claim 2 wherein said plug rotates within said reservoir and further comprising:

a second vertical bore in said valve casing which extends from said reservoir to said first horizontal bore and intersects said first horizontal bore between said second check valve and said outlet port;

a second horizontal bore which connects said second vertical bore to said first vertical bore and intersects said first vertical bore between said first check valve and said reservoir; a third check valve located at the intersection of said second horizontal bore and said second vertical bore; a release rod having a first position which holds said third check valve closed and a second position that releases said third check valve to allow unidirectional flow, said release rod extending from said plug into said second vertical bore in said valve casing such that movement of said plug causes the movement of said release rod between said positions to allow the unidirectional flow of fluid from an operating device connected to said outlet port to said reservoir when said release rod is in said second position.

4. A hand pump for pumping fluid to an operating device, comprising;

a unitary pump handle extending in a generally vertical direction;

a cylindrical reservoir forming an upper section of said handle and having an inlet near the top thereof; a cylindrical pump housing; forming a lower portion of said handle a plug which is inserted into and seals one end of said reservoir, said plug having a handle attached thereto, a valve casing having one end inserted into and sealing said reservoir and the other end inserted into and sealing said pump housing to connect said reservoir and said pump housing in a linear series to form said handle;

a piston in said pump housing; pivot means supporting said handle at said valve casing for movement about a generally horizontal axis; a pump chamber formed between said piston and said valve casing; a link arm; means close to said handle pivotally securing a point on said link arm on an axis which is fixed respecting said generally horizontal axis;

a piston rod having one end attached to said piston and the other end pivotally connected to said link arm at a location vertically spaced from the means pivotally supporting a point on said link arm such that lateral movement of said handle causes said piston to slide within said pump housing and change the size of said pump chamber;

one way flow regulating means in said casing which allows fluid to flow only from said reservoir into said pump chamber when said piston slides in a direction to enlarge said pump chamber, and allows said fluid to flow only from said pump chamber to an operating device when said piston slides in a direction to decrease the size of said pump chamber; and a single release means to open said flow regulating means to two way flow;

whereby said inlet port near the top of the reservoir is for supplying fluid on demand to said reservoir and to be pumped to an operating device.

* * * * *